US011649403B2

(12) United States Patent
Liss

(10) Patent No.: US 11,649,403 B2
(45) Date of Patent: May 16, 2023

(54) MULTI-STEP PROCESS FOR CONVERSION OF WASTE PLASTICS TO HYDROCARBON LIQUIDS

(71) Applicant: Barry Liss, Pompano Beach, FL (US)

(72) Inventor: Barry Liss, Pompano Beach, FL (US)

( * ) Notice: Subject to any disclaimer, the term of this patent is extended or adjusted under 35 U.S.C. 154(b) by 0 days.

(21) Appl. No.: 17/668,937

(22) Filed: Feb. 10, 2022

(65) Prior Publication Data

US 2022/0259502 A1 Aug. 18, 2022

Related U.S. Application Data

(60) Provisional application No. 63/148,707, filed on Feb. 12, 2021.

(51) Int. Cl.

| | |
|---|---|
| ***C10G 9/36*** | (2006.01) |
| ***C10G 1/10*** | (2006.01) |
| ***C10G 1/00*** | (2006.01) |

(52) U.S. Cl.

CPC ..... *C10G 1/002* (2013.01); *C10G 1/10* (2013.01); *C10G 9/36* (2013.01); *C10G 2300/1003* (2013.01); *C10G 2300/1011* (2013.01); *C10G 2300/4006* (2013.01); *C10G 2300/4012* (2013.01); *C10G 2300/807* (2013.01)

(58) Field of Classification Search

CPC .. C10G 1/002; C10G 1/10; C10G 2300/1003; C10G 2300/1011; C10G 2300/4006; C10G 2300/4012; C10G 2300/807; C10G 9/36

See application file for complete search history.

(56) References Cited

U.S. PATENT DOCUMENTS

2019/0276757 A1* 9/2019 Liss ..... B01D 53/40
2022/0041937 A1* 2/2022 Balducci ..... C10G 1/10

* cited by examiner

*Primary Examiner* — Ellen M McAvoy
*Assistant Examiner* — Chantel L Graham
(74) *Attorney, Agent, or Firm* — Geoffrey Lottenberg; Berger Singerman LLP

(57) ABSTRACT

A method for thermally converting plastics and biomass, and especially non-recyclable waste plastic and or biomass, to primarily liquid phase hydrocarbons is a three step process comprised of hydrothermal treatment, steam cracking and coking. Plastic or plastic and biomass feedstocks are reduced in particle size to inch minus or smaller and suspended in a liquid slurry. The slurry is pumped to high pressure and heated to a temperature high enough to initiate de-polymerization. The resulting partially de-polymerized slurry is sent to a multi-phase separation system via a pressure reduction valve and thereafter subjected to steam cracking to further reduce the average molecular weight of the hydrocarbon components. The resulting gas phase hydrocarbon mixture is quenched, and naphtha, middle distillate, and heavy oils are condensed out. The residual heavy oil phase is further reduced in pressure and sent to a coker from which additional liquid hydrocarbon product is recovered.

19 Claims, 8 Drawing Sheets

MULTI-STEP PROCESS FOR CONVERSION OF WASTE PLASTICS TO HYDROCARBON LIQUIDS

CROSS REFERENCE TO RELATED APPLICATIONS

This application also claims the benefit of U.S. Provisional Application No. 63/148,707 filed on Feb. 12, 2021.

FIELD OF INVENTION

The present invention relates to the conversion of plastic and or blends of plastic and biomass, especially from non-recyclable waste streams, to useful hydrocarbon products. More specifically, the present invention relates to conversion of non-recyclable plastic and biomass materials using hydrothermal treatment, steam cracking and coking, so as to enable broad control and optimization of quantities and qualities of the resulting hydrocarbon products.

BACKGROUND OF THE INVENTION

Thermal conversion of plastics to liquid fuels has been a subject of environmental and commercial interest for several decades. China's move to stop their import of most solid waste from foreign countries including plastics, paper products, and textiles, etc. sparked renewed interest in the commercial development of such thermal conversion systems. There is a need for environmentally sound disposal of personal protective equipment (PPE), as well as other plastics, especially thin films materials (typically polyethylene or polypropylene) ranging from large sheeting use in agricultural and construction to plastic bags to packaging/wrapping.

Small scale commercial systems, mostly of indirectly heated pyrolytic design, operating at or near ambient pressure, have been built for conversion of plastic to hydrocarbon fuels. These are mainly in developing countries for liquid fuel and or power generation purposes. However, the quality of the product hydrocarbon liquids is well below that of most crude oils, let alone refined petroleum products.

The last decade has seen significant interest and investigation into the application of hydrothermal treatment for waste conversion, including conversion of plastics to liquid and gas phase hydrocarbon fuels. The invention disclosed herein teaches an advantageous approach to converting plastics and other hydrocarbon solid waste to liquids and utilizing hydrothermal treatment combined with other more conventional and well established petroleum refining processes.

SUMMARY OF THE INVENTION

The present invention provides an integrated system for the optimal conversion of plastic waste to useful hydrocarbonaceous products, and, more specifically, the conversion of plastic waste using a system that enables broad control and optimization of quantities and qualities of the products produced. In some embodiments, the steps the process include: (a) preparation of the plastic or mixed plastics and biomass feedstock for the hydrothermal liquefaction step by cleaning and sizing the process feedstock, (b) hydrothermal treatment of the feedstock, which initiates depolymerization, (c) steam cracking of the hydrothermally activated and de-polymerizing molten plastics or plastics and biomass feedstock, (d) separation of the depolymerized and cracked feedstock into product or by-product streams, (e) recycling of a portion of the heavy oil stream and (f)) treatment of residual heavy oils in a coker, the vapors from which may be condensed, refined, and stored.

Products obtained from the thermal treatments described above yield liquid and gas phase hydrocarbons in the non-condensable, naphtha (gasoline and solvents), middle distillate (#2 diesel oil and kerosine), heavy fuel oil (boiler fuel oil and marine diesel), and heavy residual oil boiling point ranges. Coke is a dry carbon product that will be formed in the steam cracker and coker, especially if plastics with intercalated carbon black are in the feedstock.

In the following description of the present invention, it is understood that the term "plastics" may refer to single polymer plastics, thermal plastics, crosslinked polymer plastics, mixed plastics, or plastics and biomass feedstocks, or any combination thereof, especially as would be obtained from solid waste streams. The above listed materials or combinations thereof are typically non-recyclables derived from solid waste streams and will be referred to herein as "feedstock" or "feedstocks". The term "blendable", as used herein, designates distillates that can be blended with commercial petroleum fuels such as #2 diesel oil, Jet A, etc. Middle distillates directly from the process of the invention can be used for marine diesel, boiler fuel, home heating oil, etc. Middle distillate fractions may be further refined using post-production filtration and distillation, to make them suitable as stand-alone "drop in" fuels for many applications including as a stand-alone #2 diesel oil.

It should also be noted that middle distillate hydrocarbon products from conversion of plastics by the present invention are comprised of the same molecular species, within the same boiling point range, as refined petroleum derived hydrocarbon fuels. The main difference in composition is a relatively greater abundance of olefins and fewer naphthenes in the plastic derived middle distillates as compared to those refined from petroleum.

It should also be noted that plastics derived middle distillates are not fatty acid methyl ester (FAME) biodiesels, the proportion of which can blended into petroleum #2 diesel fuel is limited in many jurisdictions to 10% or less. Plastic derived middle distillates can be refined to be fully compliant with ASTM D 975 for diesel fuel.

The process also includes utility support systems, depending on feedstock characteristics and desired hydrocarbon product suite. These support or auxiliary systems include: (a) a high and low pressure hydrocarbon vent gas collection system, which delivers gas either for process heating or in an exhaust thermal oxidizer, (b) an air pollution control system with flue gas recycling and a baghouse, (c) a water management system for recycling and effluent wastewater discharge treatment, and (d) a coolant cooling and recirculation system.

The described components and utility support systems, along with other incidental but essential subsystems common to commercial facilities, such as a process monitoring and control systems, achieves plastics recycling to useful products of higher quality and lower costs than current state of the art systems. That is, the waste plastics conversion process of the present invention results in products of higher quality, at high process efficiency, and reduced costs compared to current thermal conversion processes.

The advantages compared to the current standard for plastics conversion by conventional low pressure indirect pyrolysis, or via supercritical hydrothermal plants include: (a) lower capital cost than supercritical plants for hydrothermal treatment of plastics, (b) lower operation and maintenance costs than supercritical hydrothermal treatment of plastics, (c) higher yield than supercritical hydrothermal treatment of plastics, and (d) higher quality fuel than conventional low pressure indirect pyrolysis treatment of plastics plants.

The overall process of the present invention achieves the conversion of plastics, plastics and biomass, or biomass to useful products of higher quality and lower costs than current systems. In addition, the present invention provides the flexibility to produce various converted hydrocarbons according to market demand. Using the present invention product hydrocarbons across the entire boiling point range from non-condensables to heavy fuel and residual oils qualify as ultra-low sulfur fuels, as well as low carbon intensity fuels.

Figure 1:
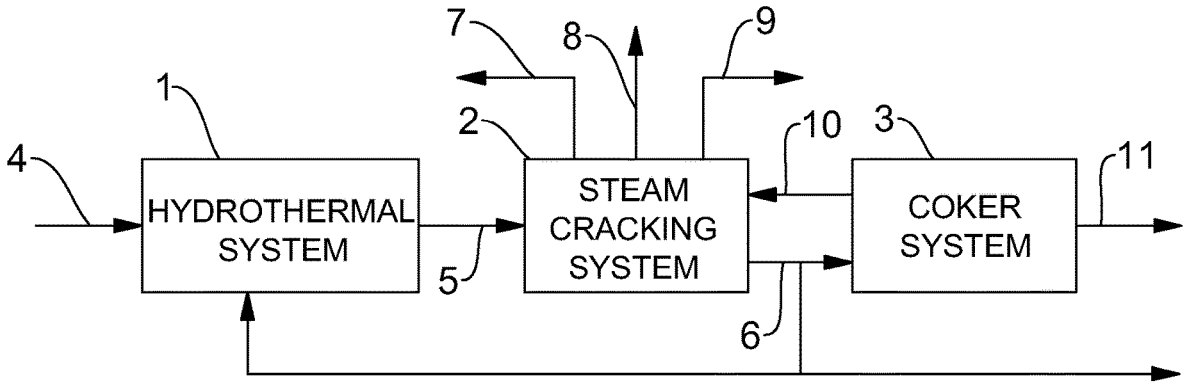
FIG. 1 illustrates the three process units or components of the present invention and their relationship to each other.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the invention of the present invention. It will be apparent, however, to one skilled in the art that the invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

The descriptions herein use the term diesel to refer to a range of middle distillate hydrocarbons, because #2 diesel oil boiling range hydrocarbon is the most common and valuable product of plastics to liquid fuels conversion. Along with non-condensable hydrocarbon gasses, other liquid phase fractions can be produced by application of the present invention, including but not limited to naphtha, middle distillate (kerosene, jet fuel, home heating oil), and heavy fuel and residual oils (marine diesel, boiler fuels and bunker oil), as well as lube oils and waxes. Likewise, the descriptions herein use heavy fuel oil to refer to heavy distillates. The following invention disclosure narrative is best understood in light of the attached diagrams, and the illustrative descriptions and examples provided, which comprise a component thereof.

With reference to FIG. 1, shown is one embodiment of the method. A hydrothermal system 1 prepares the waste feedstock 4 by hydrothermal activation and initiates depolymerization. The hydrothermal system 1 operates in a subcritical pressure and temperature range. A steam cracking system 2 takes the hydrothemally activated and depolymerizing molten plastics 5 and steam cracks them and separates them into by-product streams 7, 8, 9. A portion of the heavy fuel oil 6 produced is recycled. Cracked vapors 10 from the coker system 3 may be refined and stored in the products storage systems of this stage 2. A coker system 3 cokes the net heavy fuel 6 leaving the steam cracking system 2 and produces a coke by-product 11 along with cracked vapors 10 which are sent back to the steam cracking system 2 for separation and refining.

Figure 2:
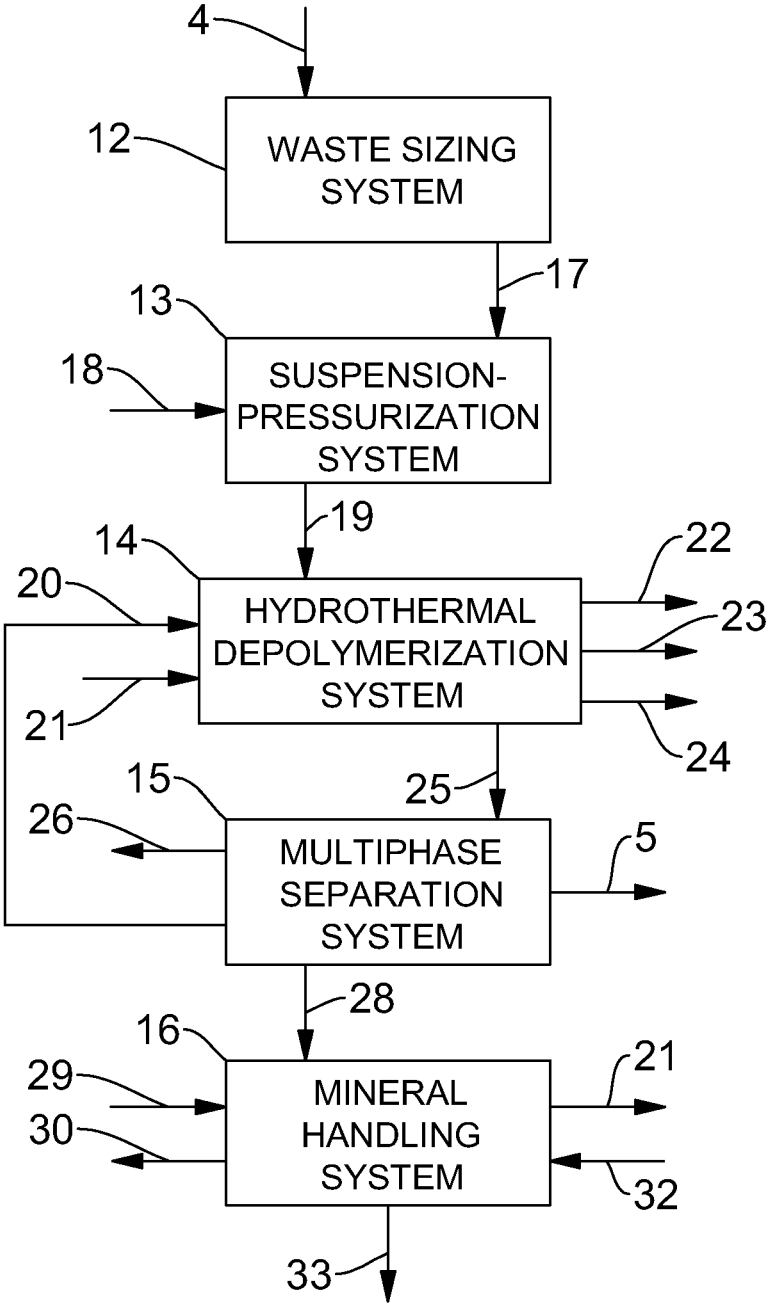
FIG. 2 illustrates the subsystem components of the hydrothermal system.

An exemplary hydrothermal system 1 is shown in FIG. 2. Waste plastics 4 are reduced to a size range suitable for aqueous suspension and transport in a feedstock sizing system 12. Cleaning and sizing processes can include dry shredding, extrusion, metal removal and/or grinding and washing. The optimal procedure varies by feedstock. Waste plastic 4 should be understood to signify not only used plastics and mixed plastic waste feedstock, but also mixed waste feedstocks that include biomass and inorganic material. The sized waste feedstock 17 is stored in a hopper and fed into the suspension and pressurization system 13 and mixed with recycled process water 18. Sized feedstock is added until the desired water to plastics ratio in the suspension is achieved for the specific application. A recirculation pump may be used to recirculate the resulting water-plastic slurry, to improve mixing and help maximize suspension density. The plastic-water suspension is discharged to a progressive cavity pump in which the pressure of the aqueous suspension of plastics is raised to the range of between 500 psia and 1,000 psia.

The pressurized aqueous suspension 19 then enters the hydrothermal depolymerization system 14, wherein the suspension is first preheated against hot recycle process water 20 in a heat exchanger. This heating brings the plastics close to their melting temperature. The aqueous plastics suspension exiting the hot water heat exchanger is then heated to 500° F.+/−25° F. against a flue gas stream 21 exiting the mineral solids dryer 16. This heating achieves hydrothermal activation and initiates de-polymerization. The resulting molten de-polymerizing plastics in aqueous suspension is then ducted to a detention tank to provide residence time to further initial de-polymerization. Non-condensables 22 in the hydrothermal detention vessel are vented to the high-pressure gas manifold 102. Cooled process water 23 exiting the hot water heat exchanger, and flue gas 24 exiting the flue gas heat exchanger then passes to the recycle process water tank 88 and flue gas cooler 142, respectively.

The molten depolymerizing plastics in aqueous suspension 25 is transferred to the multiphase separation system 15. The multiphase separation system 15 first reduces the pressure of the suspension by 50 to 200 psia across a pressure let-down valve. The optimal pressure drop depends on the average waste characterization of the feedstock 4 to provide a pressure let-down sufficient to achieve high pressure multiphase separation by density differential in a separator vessel. Non-condensables 26 at the operating conditions in the freeboard of the multi-phase separator vessel are vented to the high pressure gas manifold 102. The hydrocarbon rich phase 5, which includes interspersed water, is transferred to the steam cracking system 2 after a portion of the separated aqueous phase is blended back into the molten de-polymerizing plastics stream. The majority of the aqueous phase 20 is recycled to the hot water heat exchanger in the hydrothermal depolymerization system 14.

The mineral sludge 28 at the base of the multi-phase separator vessel is discharged through mineral handling system 16, which may include a dryer, a cooler and storage. Hot flue gas 29 from the downstream of the steam cracker 36 is used to dry the mineral solids. A glycol-water coolant 32, from the cooler 116, may be used to cool the solids in an indirect contact augered cooler with the discharge 30 sent back to the cooler 116. Dried mineral solids 33 may be landfilled.

Figure 3:
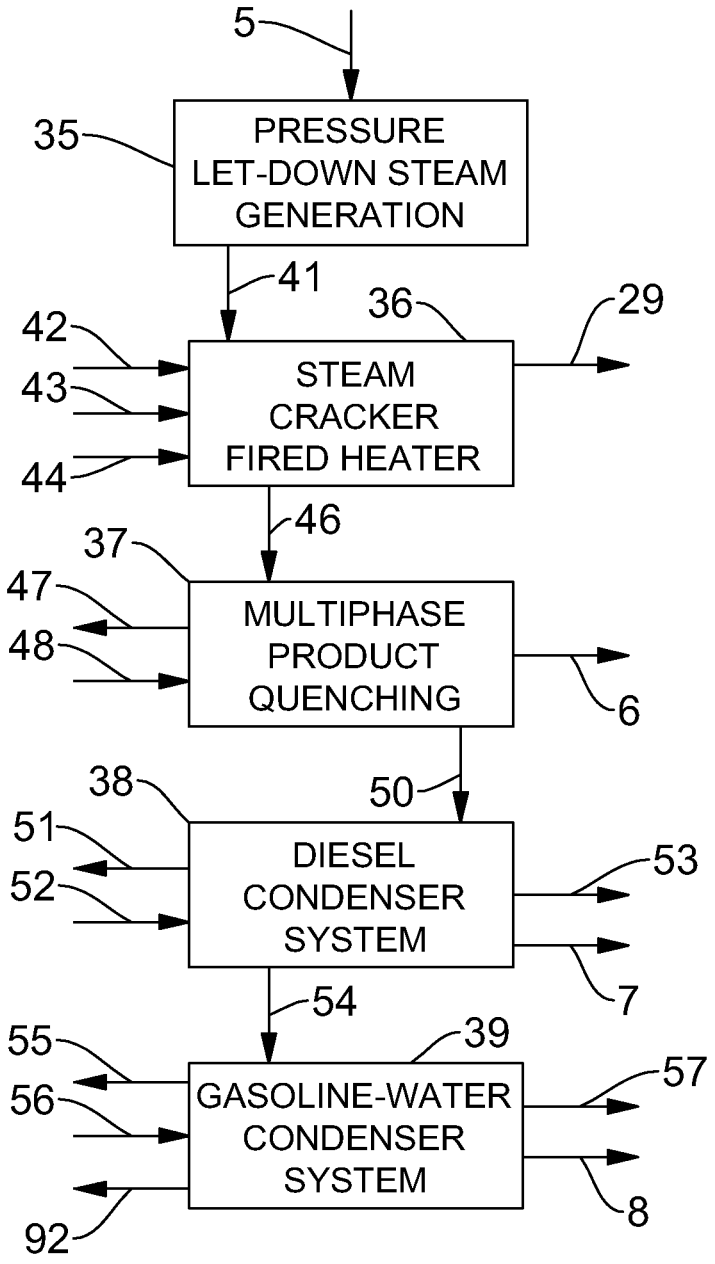
FIG. 3 illustrates the components of the steam cracking system.

The steam cracking system 2, an example of which is shown in FIG. 3, includes several subsystems. One skilled in the art will recognize that the steam cracker described herein can be structurally similar to, and provide the functions of, a visbreaking furnace. Molten de-polymerizing plastics 5 with interspersed and additional high pressure water from the multiphase separation system 15 are transferred across a pressure let-down valve 35 resulting in steam generation in the 175 to 200 psia pressure range. This stream of steam and molten de-polymerizing plastics 41 which may include un-vaporized interspersed water enters a steam cracking fired heater 36.

The temperature of the steam and hydrocarbon rich multi-phase mixture is raised from below 400° F. to over 800° F. at the exit of the steam cracker 36. In one embodiment of the invention, the fired heater is outfitted with a low NOx burner that incorporates the premixing of recycle flue gas 44, air 42 and recycled product fuel gases 43 from the high pressure fuel gas storage tank 104 to provide process heat to drive the endothermic reactions. The product mixture of heavy hydrocarbon liquids, coke particles, cracked hydrocarbon vapors and water gas 46 are ducted to a multiphase separation and quenching system 37. In the multiphase separation and quenching system 37 a venturi quench, is cooled by recirculating heavy fuel oil to 700° F. prior to entering a vapor-liquid separator. Heavy fuel oil 6 is discharged through the base of the separator with a portion sent across a pressure let-down valve 60. The reduced pressure heavy oil 66 is fed into the coker 61. The balance of the heavy oil is cooled in a heat exchanger and pumped across the venturi exchanger quenching the multi-phase phase mixture from above 800° F. to 700° F. or below and condensing the heavy fuel oil out of the multi-phase mixture fed. A glycol-water coolant 48, from the dry cooler 116, is used to cool the recirculating heavy fuel oil in a shell and tube heat exchanger with the discharge 47 sent back to the dry cooling 116.

The vapor steam 50 exiting the separator contains species in the diesel boiling range and lower. This vapor stream 50 is ducted to a diesel condensing system 38, comprised of an indirect parallel plate condenser in which the temperature is reduced to 300° F. or lower, thereby condensing out diesel boiling range hydrocarbons. A glycol-water coolant 52, from the cooler 116, is used as coolant in the parallel plate heat exchanger, with the discharge 51 sent back to the cooler 116. The multi-phase mixture exiting the condenser is fed into a vapor liquid knock-out drum. Product diesel oil exiting the base of the drum is let down in pressure with the vapor-liquid stream produced separated in a second knock-out drum. Vapors 53 exiting this drum are ducted to the low-pressure fuel gas manifold 100, while the liquid product 7 is sent to the diesel product storage tank. The gas vent 106 from the diesel storage tank is also ducted to the low-pressure fuel gas manifold 100.

Vapors 54 leaving the diesel condenser system 38 are fed to a naphtha-water condenser system 39, which includes a parallel plate indirect condenser in which the temperature is reduced to 77° F. or lower thereby condensing out naphtha boiling range hydrocarbons and the bulk of the water vapor entering. Glycol-water coolant 55, 56 is used to cool the condenser. A chiller may be deployed to enable the condenser to operate at or below 77° F.

Dewatering chemicals are added to the multi-phase mixture exiting the condenser, which is fed into a vertical oil, water, and vapor separator. Water 92 is removed from the separator base and recycled to the water management system's recycle process water tank 88. Non-condensable vapors 57 exiting overhead from the separator are ducted to the high-pressure fuel gas storage tank 104. Product naphtha floating on top of the water layer of the separator bottom is then let down in pressure with the vapor-liquid stream produced separated in a knock-out drum. Vapors 59 exiting this drum are ducted to the low pressure fuel gas manifold 100 while the liquid product 8 is sent to a naphtha product storage tank. The gas vent 107 from the naphtha storage tank is also ducted to the low-pressure fuel gas manifold 100.

Figure 4:
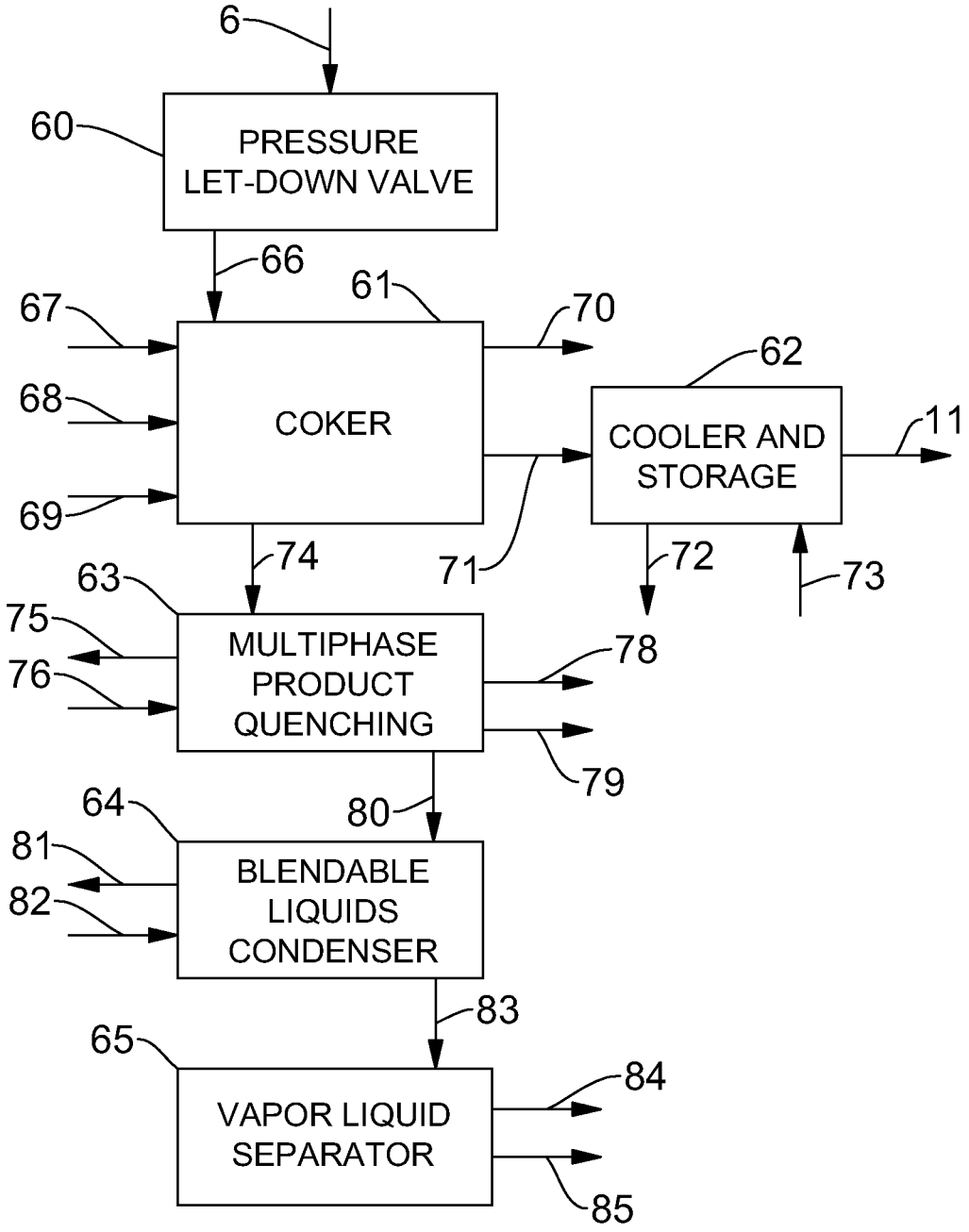
FIG. 4 illustrates the components of the coker system.

The coker system 3, an example of which is shown in FIG. 4, includes several components. The portion of the heavy fuel oil product 6 that is split for final processing in the coker system 3 is first let down in pressure by a pressure let-down valve 60 and then fed to a coker unit 61. In one embodiment of the invention, the coker unit 61 may be an, at near ambient pressure, indirectly fired, augered kiln. In one embodiment of the invention, the coker unit 61 is heated with a low NOx burner that incorporates the premixing of recycle flue gas 69, air 67 and recycled product fuel gases 68 from the high-pressure fuel gas storage tank 104. This provides process heat to drive the endothermic reactions of pyrolytic coking of the heavy fuel oil. In another embodiment of the invention, the coker unit is built with the inlet at a base elevation and the exit higher than the inlet. This configuration facilitates the heavy oil to be coked dry by operating the kiln with an exit temperature of the coker solids above 1000° F.

The coke 71 exits the coker 61 into an augered cooler 62 and is cooled indirectly with a glycol-water mixture 72, 73 provided from the cooler 116. The vapors 74 exiting the coker 61 at or slightly below the coke exit temperature are quenched to 700° F. in the coker quench separator 63, condensing the heavy oil fraction 78. A heat exchanger, cooled by a glycol-water mixture 75, 76 provided from the cooler 116, cools the recirculating heavy fuel oil. A low-pressure pump may be provided to generate the head required to operate the venturi quench. A portion of the heavy oil 79 split off and pumped to high pressure for recycle to either the hydrothermal system 1 or the steam cracking system 2 for further de-polymerization and or steam cracking. The net product fuel oil is withdrawn from the discharge of the low pressure pump.

Naphtha and lighter hydrocarbons 80 exiting the coker quench separator 63 are ducted to the blendable liquids condenser 64. In one embodiment of the invention, the blendable liquids condenser 64 may be a parallel plate heat exchanger. This heat exchanger is cooled to 77° F. by a glycol water mixture 81, 82 from the cooler 116. A chiller may be deployed to enable the condenser to operate at or below 77° F. The multiphase mixture of diesel and lighter hydrocarbons 83 are separated in a vapor liquid separator 65 producing a blendable liquid bottoms product 85 that is directed to a liquid blend tank. The overhead vapors 84 are ducted to the low pressure fuel gas manifold 100.

Figure 5:
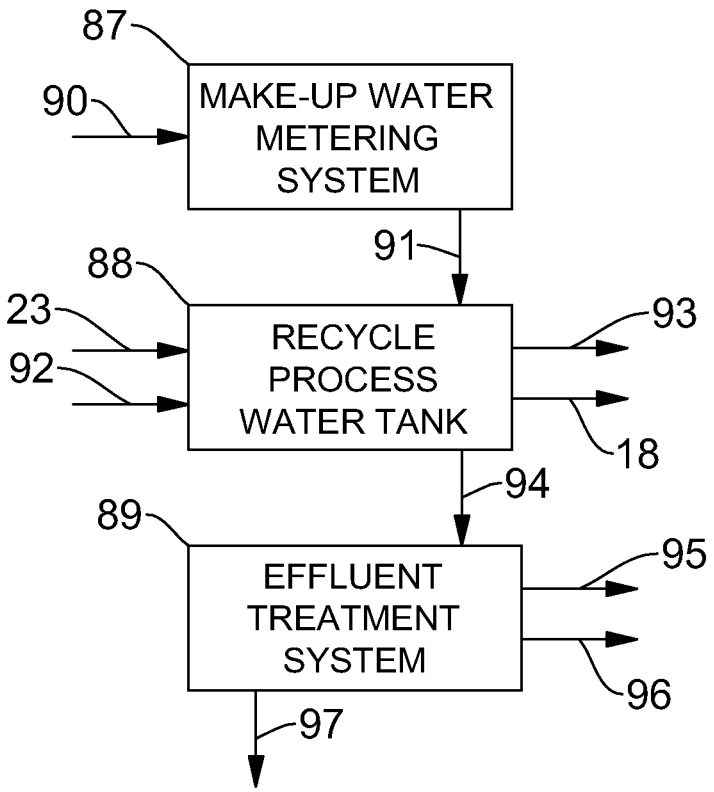
FIG. 5 provides the flow diagrams for the water management system.

In addition to the three primary steps of the process, there are four major auxiliary systems. An exemplary water management system is shown in FIG. 5. The water management system includes several subsystems. In embodiments of the invention that utilize a low moisture content plastic waste feedstock, make-up water 90 may be required, corresponding to a net consumption of water, predominantly in the steam cracker 36. Such low moisture content waste plastics may include polyethylene and/or polypropylene and/or polystyrene. A make-up metering system 87 may be used to achieve water balance. In embodiments of the inventions where the feedstock contains significant biomass, there may be a net generation of water and make-up water 90 may not be required. The water management system includes a recycle process water tank 88. This tank 88 will receive recycle process water 23 from the high-pressure separator 15 after it flows through the hot water heat exchanger in the hydrothermal depolymerization system 14. Said tank 88 will also receive recycle process water 92 from the low pressure naphtha-water condenser 39, in addition to any make-up water 91 required. Vent gases 93 from said tank is ducted to the high pressure vent gas manifold 102. To maintain water quality, a portion of the process water 94 is sent to an effluent treatment system 89.

The water management system includes an effluent treatment system 89, the overall configuration of which depends on the characteristics of the waste plastic feedstock. In one embodiment of the invention, the main function of the effluent treatment system 89 may be to remove dissolved hydrocarbon systems, while in other embodiments an aerobic and anaerobic treatment may be required to achieve effluent compliance standards. In addition it may be technically and economically feasible to generate green substitute natural gas via anaerobic digestion in the effluent treatment system 89. This is especially the case with higher percentage contents of biopolymers versus waste plastics. The effluent treatment system 89 produces clean water 96 for discharge and produce vent gases 95 of similar energy content to the fuel gas generated 57. A dried sludge 97 is also produced.

Figure 6:
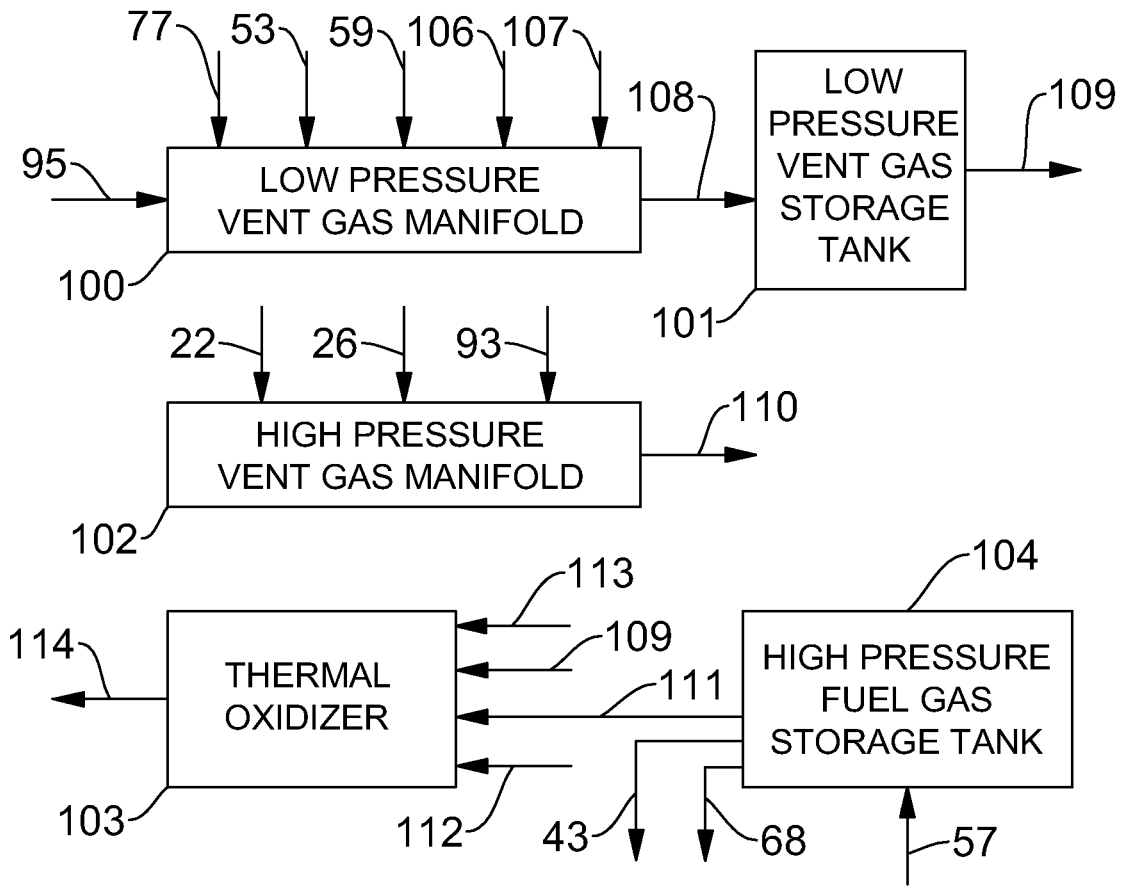
FIG. 6 provides the flow diagrams for the fuel gas system.

An exemplary fuel gas management system is shown in FIG. 6. A low-pressure vent gas manifold 100 providing low pressure fuel gas 108 to a storage tank 101 for fuel gas surge control. Fuel gas 109 from the storage tank 101 is sent to a thermal oxidizer 103. Vent gases 77, 106, 107 from the heavy fuel oil, diesel and naphtha storage tanks are collected in the manifold 100 along with let-down vent gases 53, 59 from the diesel and naphtha knock-out drums.

A high-pressure vent gas manifold 102 educts high pressure vent gases 110 through the heavy fuel oil venturi quench nozzle in the multiphase product quenching system 37. A high-pressure gas storage tank 104 stores gases 57 venting from the non-condensables, naphtha and water condenser system 39. Gases 43, 68 from the storage tank 104 fuel the steam cracker burner 36 and the coker 61, with the balance of the gas 111 burned in the thermal oxidizer 103. The thermal oxidizer 103 uses air 113 blended with recycle flue gas 112 to cleanly burn both high-pressure fuel gas 111 and low-pressure fuel gas 109 with low NOx emissions.

Figure 7:
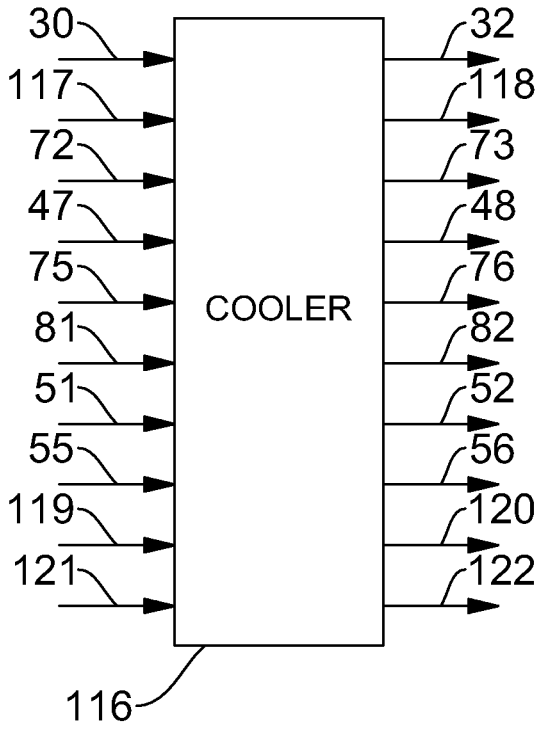
FIG. 7 provides the flow diagram for the coolant system.

Thermal oxidizer flue gas 114 and coker burner flue gas 70 are combined with the flue gas 45 from the steam cracker 36 and used for mineral solids drying and aqueous plastics suspension pre-heating as described. In embodiments producing large volumes of gas, excess heat or gas may be used to generate electricity. Electrical generation may be accomplished using excess fuel gas 111 directly in reciprocating engines, or by recovering the heat from flue gas 114 to power a Rankine cycle or organic Rankine cycle system. In embodiments using a Rankine cycle, a portion of the hot flue gas 114 from the thermal oxidizer 103 is ducted to a heat recovery steam generator, which provides steam for electrical generation. In embodiments using an organic Rankine cycle, the flue gas cooler 142 includes an oil heat exchanger for transferring waste heat prior to the cooling of the flue gas An exemplary cooler system is shown in FIG. 7. Warmed coolants 30, 47, 51, 55, 72, 75, 81, 117, 119 exit the mineral solids cooler 16, the carbon solids cooler 62, the heavy fuel oil quench cooler 37, the coker multiphase quench 63, the diesel condenser 38, the naphtha-water condenser 39, the blendable liquid condenser 81 and the flue gas cooler 142 and are cooled in a cooler 116.

In one embodiment of the invention an air-cooled dry cooler is used. Cooled water 32, 48, 52, 56, 73, 76, 82, 118, 120 leaving the cooler 116 and are recycled to their respective coolers. To achieve control and capture of condensing of the naphtha and blendable liquids, the glycol-water coolant is cooled to 35° F. or lower in a chiller. Ambient air 121, 122 may be used to operate the cooler.

Figure 8:
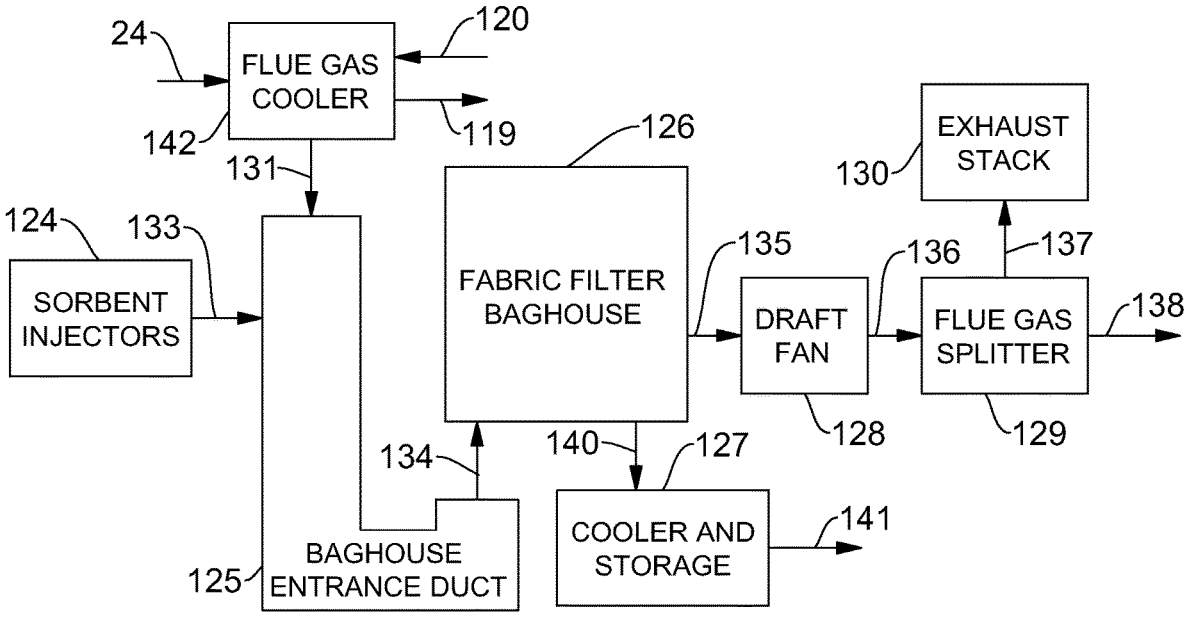
FIG. 8 provides the flow diagram for the flue gas recycle and exhaust management system.

An exemplary air pollution control system is shown in FIG. 8. The air pollution control system is only included if flue gas requires cleaning to be compliant with applicable air emission regulations. Flue gases 45, 70, 114 generated in the steam cracker fired heater 36, the coker 61, and the thermal oxidizer 103, are combined into a single flue gas stream 29. After exiting the hydrothermal depolymerization system 13, the combined flue gas 24 enters the flue gas cooler 142 where it is cooled to approximately 300° F. Cooled flue gas 131 enters the bag-house entrance duct 125. Sorbent injectors 124, inject sorbents 133, such as activated carbon and acid gas capture reagents, into the entrance duct 125. Flue gas 134 enters the fabric filter baghouse 126, where reacted air pollution control solids and any other particulates 140 are removed. After being cooled and stored in a designated system 127 the collected air pollution control collected solids 141 may be disposed in a landfill. The clean product gases 135 exiting the baghouse 126 are pass through a draft fan 128. Flue gas 136 leaving the draft fan 128 enters a flue gas splitter 129. A portion of flue gas 138 is recycled for low NOx, burner operations. The remaining flue gas 137 is released to the atmosphere through an exhaust stack 130.

In embodiments producing large volumes of gas, excess heat or gas may be used to generate electricity. Electrical generation may be accomplished using excess fuel gas 111 directly in reciprocating engines, or by recovering the heat from flue gas 114 to power a Rankine cycle or organic Rankine cycle generating system. In embodiments using a Rankine cycle, a portion of the hot flue gas 114 from the thermal oxidizer 103 is ducted to a heat recovery steam generator, which provides steam for electrical generation. In embodiments using organic Rankine cycle, the flue gas cooler 142 includes a heat exchanger between the entering flue gas and an oil heating system, upstream of the cooler.

Certain embodiments of this invention arise mainly from the composition of the plastic, or mixed plastic and biomass waste, its morphology, and local factors ranging from quantities of waste available to the product mix desired in local markets. The latter consideration can be affected by seasonal and or temporal market demands as to how these factors can best be incorporated into an optimal processing configuration.

In any embodiments of this invention, the yield of different hydrocarbon fractions can be controlled by variation of feed flow rate, waste composition fed, water to waste ratio, operating temperatures, pressures, and residences times in the various processes. These conditions may be altered to achieve optimal product ratios on daily, weekly, and/or seasonal bases.

Waste plastics that were produced by free radical addition polymerization of olefinic monomers such as ethylene and propylene do not typically decompose significantly under subcritical hydrothermal conditions. However, with the subsequent steam cracking of the partially depolymerizing plastics, problematic plastics can be depolymerized thermally in the steam cracking and/or coker process. With the three processes included, the yield of middle distillates and the quality of the heavy fuel oil is improved. This occurs from both the additional pyrolytic cracking, and by the separation of a dry carbon or coke product. Thus, the flexibility in the three-step thermal processing taught in this patent application supports the goals of those focused on achieving circular economy for plastics management.

Catalysts may also be used to address the problem of insufficient depolymerization. In one embodiment of the invention, a cracking catalyst, such as bentonite, may be used in the hydrothermal depolymerization system or in the steam cracking system. Catalyst may be most suitable in the processing of the aforementioned free radical addition produced polymers from vinyl monomers. The spent catalyst may be removed in the mineral sludge exiting the high-pressure separator downstream in the hydrothermal treatment step. Alternatively, where a catalyst is required in the steam cracking process, the catalyst exits the system in the carbon or coke by-product.

Oxygen containing feedstocks require special consideration. As the percentage of oxygen content in the waste increases, whether from the percentage of polyethylene terephthalate or from the percentage of a condensation polymer such as nylon, the percentage of chain length reduction that can be achieved in subcritical hydrothermal treatment increases. One impact of this is the generation of oxygenated hydrocarbons. These commonly have solubilities in water that are typically an order of magnitude or two or more than hydrocarbon whose elemental composition is carbon and hydrogen atoms only. The main impact is that these water-soluble oxygenated hydrocarbons build up in the water recirculation loop.

In embodiments that process only hydrocarbon polymers, the circulating process water will contain increased levels of the light hydrocarbons formed from thermal depolymerization. For this case, wastewater treatment of the dissolved hydrocarbons can be readily achieved by activated carbon absorption and activate oxygen polishing steps.

In embodiments that treat biopolymers and biomass, the water treatment system must handle dissolved oxygenated compounds. The auxiliary water management system for such a processing facility must have a combination of aerobic and anaerobic treatments to remove such compounds.

The optimal process used in the subsystems of this invention will change with the scale of the facility. This disclosure of the invention describes the use of simple condensation schemes for product separation, including by direct contact methods of quenching and by indirect condensing using typically cost effective parallel plate condensers. One skilled in the art should appreciate that there is an economy of scale above which such basic separations techniques may be replaced by distillation columns similar to those in petroleum refineries for product separation and refining. Nominally, 1,000 barrels of oil to be distilled is considered a rough threshold for such economy of scale considerations. Similar substitutions may be applicable to the steam cracking and coking processes, that also have analogous large-scale petrochemical processes.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A method for thermal conversion of biopolymer waste or waste plastic to liquid and gas phase hydrocarbons, the method comprising:

hydrothermally treating an aqueous slurry of the biopolymer waste or waste plastic at elevated pressure and temperatures in the subcritical range to produce hydrothermally treated molten de-polymerizing waste solids;

steam cracking the hydrothermally treated molten depolymerizing waste solids to produce high molecular weight gas and liquid phase hydrocarbons; and treating the high molecular weight gas and liquid phase hydrocarbons in a coker system to recover hydrocarbon oils and residual coke or carbon black.

2. The method according to claim 1 wherein the waste plastic is non-recyclable plastic, or a mixture of biomass and plastics.

3. The method according to claim 1 wherein the hydrothermal treatment includes:

particle size reduction of the biopolymer waste or waste plastic;

suspension and pressurization of biopolymer waste or waste plastic in an aqueous suspension;

indirectly heating the aqueous suspension to achieve hydrothermal depolymerization thereof;

separation of the treated aqueous suspension into gas, hydrocarbon, aqueous and solid phases; and drying the resultant solid phase for storage and disposal.

4. The method according to claim 3 wherein the particle size of the biopolymer waste or waste plastic is reduced by one of more of mechanical shredding, extrusion, washing and/or grinding.

5. The method according to claim 3 wherein a catalyst may be employed to reduce the operating temperature and pressure of the hydrothermal depolymerization or increase the reaction rate.

6. The method according to claim 3 wherein inorganic contamination of the biopolymer waste or waste plastic is removed in the aqueous suspension tank instead of, or in addition to, a high pressure multiphase separator vessel.

7. The method according to claim 1 wherein the steam cracking process includes:

pressure let-down with steam generation, forming a steam-liquid plastic suspension;

steam cracking of the steam-liquid plastic suspension in a fired heater;

quenching and separation of the resultant cracked product into cracked vapors and heavy fuel oil; and multiple stages of separation and quenching of the cracked vapors into various hydrocarbon streams.

8. The method according to claim 7 where additional high pressure water, from the water phase that forms below the molten de-polymerizing hydrocarbons is blended to control a steam to hydrocarbon ratio within the fired heater.

9. The method according to claim 7 wherein a visbreaking process is substituted for the steam cracking step.

10. The method according to claim 7 wherein a dewatering chemical is added to the multi-phase mixture exiting the naphtha and water condenser.

11. The method according to claim 1 wherein the coking process includes:

pressure let-down of the hydrocarbon oil;

coking of the hydrocarbon oil in a fired heater, generating hydrocarbon vapors and coke; and multiple stages of separation and quenching of the hydrocarbon vapors into various hydrocarbon streams.

12. The method according to claim 11 wherein the coker consists of indirectly heated augered kiln with the entry of the heavy fuel oil at a base height that is lower than that of the dried coke and cracked vapors exit point.

13. The method according to claim 11 wherein the pressure let-down is designed and operated to cause interspersed water in a high pressure separator to form steam in-situ via adiabatic expansion across the valve.

14. The method according to claim 11 wherein hydrocarbon oil is recycled to either an entrance to the hydrothermal system's hot water heat exchanger and/or into an inlet to the steam cracker.

15. The method as in claim 14 wherein depolymerizing biopolymers and or plastic waste are used to control and optimize the quantity and quality of liquid fuel produced per unit mass of waste processed.

16. The method according to claim 1 wherein cooling of the multi-phase mixture exiting the steam cracking system is achieved in a direct contact condensing of a type other than a venturi contactor.

17. The method according to claim 16 wherein direct contact condenser type is a quench tower.

18. The method according to claim 1 wherein an organic Rankine cycle system is used to generate electric power using heat extracted from the gas.

19. The method according to claim 1 wherein the gas is used to generate electric ver.

* * * * *